US005145077A

United States Patent [19]

Röhrig

[11] Patent Number: 5,145,077

[45] Date of Patent: Sep. 8, 1992

[54] FEEDING BOTTLE INCLUDING A NIPPLE ADAPTER RING FOR SUPPORTING THE NIPPLE

[75] Inventor: Peter Röhrig, Wien, Austria

[73] Assignee: Mam Babyartikel Gesellschaft M.B.M., Wien, Austria

[21] Appl. No.: 477,826

[22] PCT Filed: Oct. 3, 1988

[86] PCT No.: PCT/AT88/00075

§ 371 Date: Mar. 14, 1990

§ 102(e) Date: Mar. 14, 1990

[87] PCT Pub. No.: WO89/03204

PCT Pub. Date: Apr. 20, 1989

[30] Foreign Application Priority Data

Oct. 9, 1987 [AT] Austria ..... 2673/87

[51] Int. Cl.[5] ..... A61J 9/00; A61J 9/02; A61J 9/08; A61J 11/04

[52] U.S. Cl. ..... 215/11.1; 215/11.2; 215/11.6

[58] Field of Search ..... 215/11.1, 11.3, 11.5, 215/11.6, 11.2

[56] References Cited

U.S. PATENT DOCUMENTS

| | | | |
|---|---|---|---|
| 2,480,247 | 8/1949 | Jamison et al. | 215/11.6 |
| 2,493,380 | 1/1950 | Bailey | 215/11.5 |
| 2,524,021 | 9/1950 | Rigby et al. | 215/11.3 |
| 2,767,871 | 10/1956 | Shapiro | 215/11.5 |
| 2,885,104 | 5/1959 | Greenspan | 215/11.1 X |
| 2,959,314 | 11/1960 | Sanchez | 215/11.1 |
| 3,182,841 | 5/1965 | Searer | 215/11.1 |
| 3,248,231 | 4/1960 | Wilson et al. | 215/11.6 X8 |
| 3,286,864 | 11/1966 | Patterson | 215/11.5 |
| 3,310,190 | 3/1967 | Hurst | 215/11.6 |
| 3,495,993 | 2/1970 | Barr et al. | 215/11.1 X |
| 3,549,036 | 12/1970 | Ritse | 215/11.6 |
| 3,650,270 | 3/1972 | Frazier | 215/11.1 X |
| 3,718,360 | 2/1973 | Knutzen | 215/11.6 |
| 3,946,888 | 3/1976 | Tonkin | 215/11.5 |
| 4,850,496 | 7/1989 | Rudell et al. | 215/11.6 X |

FOREIGN PATENT DOCUMENTS

| | | | |
|---|---|---|---|
| 9460 | 4/1980 | European Pat. Off. | 215/11.1 |
| 137458 | 4/1985 | European Pat. Off. | 215/11.1 |
| 345694 | 12/1989 | European Pat. Off. | 215/11.1 |
| 3317849 | 11/1984 | Fed. Rep. of Germany . | |
| 2446632 | 8/1980 | France . | |
| 2538699 | 7/1984 | France . | |
| 8606273 | 11/1986 | PCT Int'l Appl. | 215/11.1 |
| 44914 | 10/1908 | Switzerland | 215/11.6 |
| 1027101 | 4/1966 | United Kingdom | 215/11.1 |

*Primary Examiner*—Sue A. Weaver
*Attorney, Agent, or Firm*—Ladas & Parry

[57] ABSTRACT

A feeding bottle comprises a bottle body of a wide neck with an opening, a substantially rigid upwardly dome-shaped adapter ring detachably fitting to the neck and having an upper supporting surface defining a central opening, a teat with its flat radial flange merely resting on the supporting surface, and a clamping cap to retain the teat by clamping the teat flange against the supporting surface of the adapter ring. The supporting surface serves as a counterclamping surface for the clamping attachment of the teat. The outer diameter of the teat flange is substantially smaller than the inner diameter of the opening of the wide bottle neck.

10 Claims, 3 Drawing Sheets

FEEDING BOTTLE INCLUDING A NIPPLE ADAPTER RING FOR SUPPORTING THE NIPPLE

The invention relates to a feeding bottle comprising a bottle body with a wide bottle neck to which a teat with a radial flange is attached or adapted to be attached by means of a cap, particularly a connection-nut screw cap, the cap at least indirectly clamping the flange against the upper edge of the neck of the bottle and having a central opening for the teat.

A number of feeding bottles have been known (cf., e.g. British Patent 1,027,101, U.S. Pat. Nos. 2,959,314 and 3,495,993 and French Patent 2,446,632), which conventionally have a relatively narrow bottle body or at least a narrow bottle neck with a teat thereon for the use of the bottle. It has been also known to insert plate-shaped valve members between the bottle neck and the teat for preventing sucking-in air (British Patent 1,027,101, U.S. Pat. No. 2,959,314 and French 2,446,632).

French Patent 2,538,699 shows a comparable feeding bottle with a reflux valve between the neck of the bottle and the teat, the valve making possible the draining of the teat when drinking, even without sucking, by compressing the teat, e.g., with lips.

From U.S. Pat. No. 3,495,993 is likewise known a "narrow neck" feeding bottle with a hermetically closing cap between the teat and the neck of the bottle; said cap has to be pressed in before the bottle is used.

In comparison with these known "narrow-neck" feeding bottles, broad bottle necks of a diameter only slightly or not at all smaller than the diameter of the bottle body proved to be superior because they make it easier to clean the inside of the bottle. It is expedient for such purpose to provide a bottle of a comparatively large diameter because this makes it possible to produce a bottle of a more compact, lower shape with of the same capacity. In addition, the bottle is then sturdier.

Such wide neck bottle is known from European Patent 9460, where the teat is in a conventional way applied on the upper neck edge of the bottle by means of a screw cap. The teat has then its radical flange clamped to the upper edge of the bottle neck, the clamping area being quite narrow. This can make the teat unintentionally, also by the infant baby, readily pressed down into the inside of the bottle or withdrawn from the clamping position, thus entailing the risk that the infant baby would swallow it and suffocate.

The wider the neck of the bottle and, therefore, the wider the teat, the greater the risk of this release of the teat. Another disadvantage of this known feeding bottle is that it is necessary to use correspondingly large teats, with a broad base corresponding to the neck of the bottle. In this connection, the teat material currently preferred for hygienic and manufacturing reasons, namely, silicone rubber, is relatively expensive, so that the cost of the teat is very high. Considering that usually various liquid food-stuffs, such as milk, tea, mash for babies, are dispensed from the same feeding bottle, it becomes necessary to keep a supply of teats with various sizes of outlet openings as well as store an assortment of teats. All above-mentioned high costs for relatively large teats become still greater by storing relatively large teats.

From U.S. Pat. No. 3,650,270, U.S. Pat. No. 3,182,841 and WIPO 86/06273 are known embodiments where a teat of a smaller cross section than the neck of the bottle is attached to the bottle opening by using a screw cap having a central inlet opening for the teat to be fixed therein. According to U.S. Pat. No. 3,650,270 and U.S. Pat. No. 3,182,841, this takes place by the flange and web portions of the screw cap interlocking with the teat; but the teat cannot be adequately securely anchored. The result is that the above described disadvantages are aggravated by the risk that the teat could be swallowed. According to WIPO 86/06273, the silicone rubber teat should be permanently anchored in the opening of the screw cap of thermoplastic material by injection molding. If the teat must be changed in such feeding bottle, the unit teat-screw cap must be always changed; this is uneconomical and, in addition, takes much space.

The object of the invention is to overcome these disadvantages and make possible the use of relatively small teats, which nevertheless can be securely anchored on wide bottle necks.

For such purpose, the feeding bottle of the invention of the above described kind is distinguished by a bottle neck whose inner diameter is greater than the outer diameter of the radial flange of the teat, and a substantially rigid adapter ring functioning as a reducing part and disposed between the upper edge of the bottle neck and the radial flange of the teat, the upper side of the adapter ring forming a counterclamping surface for the cap and the radial flange.

The adapter ring of the invention reduces the outlet diameter to a smaller size than the diameter of the bottle neck, and this reduced outlet diameter expediently corresponds to the diameter to the teats available in commerce for narrow feeding bottles. The adapter ring can have a relatively broad, annular clamping surface for the flange of the teat, so that it is possible to use commercially available teats of various diameters and nevertheless clamp them securely between the adapter ring and the cap. The cap can be tightened on the bottle in a conventional way by means of a threaded screw or a bayonet catch. The relatively broad annular clamping surfaces on the adapter ring (and correspondingly on the inner side of the upper wall of the cap) provide also the advantage that the teat can be securely held by its teat flange in spite of lesser surface pressure; this saves material. As mentioned, this secure clamping is not affected by using somewhat different sizes of the teats.

The use of smaller teats involves less material and expense, and this is advantageous for the above-mentioned storage of supplies. The adapter ring, which can be described as a reducing part, contrary to the teat preferably made of silicone rubber, can be prepared of substantially cheaper plastic material, and only one adaptor ring is required for a bottle.

Let it be mentioned that from EP 137,458 is known a baby milk bottle having an opening and withdrawal cap, a cylindrical abutment of the same outer diameter as the bottle neck being adapted to be set on the upper edge of the bottle. A teat is then clamped on the upper side of said cylindrical abutment by a screw cap, which is screwed on the cylindrical abutment and then screwed together with the bottle neck. The teat has a lower radial flange of a diameter about equal to that of the narrow bottle neck. To avoid unintended pressing of the teat into the bottle through the upper opening of the cylindrical abutment, the cylindrical abutment has a flange-like pulled up opening edge on the upper side, around which the lower edge of the teat is outwardly clamped. Consequently, this known embodiment is fit for the use only with a teat of a predetermined, specific size. Besides, it should be pointed out above all that the purpose of the cylindrical abutment with its inner profiles is to open a bottle closure provided for sterile handling over a thereon formed projection and a nominal place of fracture.

The adapter ring, i.e. more specifically its upper side in the bottle of the invention can have the shape of an arched cupola or truncated cone, the cap having its inner wall correspondingly shaped. It is of particular advantage in the production and handling if the upper side of the adapter ring is plane, at least in the inside area adjoining the ring opening. The cap is correspondingly plane. This planar formation is also on account of the fact that most commercially available teats have a horizontal radial teat flange, which can be particularly securely protectively clamped between both plane clamping surfaces by exerting uniform pressure.

To provide in a particularly simple way an afterflow of air into the inside of the bottle for equalizing pressure inside the bottle, it is expedient if at least one ventilation groove extends in the upper side of the adapter ring from the inner ring opening to the circumferential edge. This is helpful when drinking from the bottle.

Preferably, two diametrically opposite, radially extending ventilation grooves are provided for such purpose. These grooves, which may be, for example, 1–2 mm broad and 0.5–1 mm deep, do not interfere with air flowing in, even if the teat flange is firmly clamped against the upper side of the adapter ring, but they provide an adequate resistance to the flow of the liquid foodstuff contained in the bottle, particularly if it is of mash-like consistency, so that its-unintended-outflow is effectively prevented.

Considering a uniform surface pressure on clamping surfaces of equal size, to provide faultless fixing of the teat in a position turned by 180 degrees, in which it projects into the inside of the bottle, such as for storing and transporting, it is expedient if the inner opening of the adapter ring is of a diameter at least substantially equal to the diameter of the central opening in the cap.

To fix the position when assembling the feeding bottle, it is also advantageous if the adapter ring has a downwardly offset axial flange, which fits into the bottle neck opening, e.g. in a clamp seat. It is also advantageous in this connection if the adapter, ring has a radially extending lug, e.g. in the shape of a circumferential collar, which in the position of use, lies on the upper side of the bottle neck. It could be also conceivable, instead of a circumferential flanged collar to provide a plurality of circumferentially spaced, curl-like projections on the outer side of the adapter ring.

A particularly simple embodiment is an adapter ring made from a flat annular plate.

As already mentioned, the annular counterclamping surface of the adapter ring should be preferably plane, but—if so desired—also in the shape of a truncated cone or dome. But in all such cases it is particularly advantageous for uniform clamping of the feeding bottle if the annular counterclamping surface of the adapter ring extends in parallel to the annular clamping surface of the cap on the inner side from its upper wall.

An advantageous embodiment of the feeding bottle of the invention is also characterized, in that, the adapter ring is tray-shaped, its outer side conforming to the inner side of a likewise tray-shaped cap, the outer side of the cap again conforming to the inner side of a set-on sector of a beaker-shaped closure cap, fastened or adapted to be fastened in a snap seat on the cap. Thus, in assembled condition of this embodiment, three tray or dome-shaped components lie within each other, which results in an exceptionally compact, stable condition. The closure cap can be used for drinking as a beaker.

It is also advantageous for better handling if the tray-shaped cap, when set on the neck of the bottle, secures a holding ring in its axial position, such ring sitting on a shoulder transition between the body and the neck of the bottle and having projecting holding grips. It is also advantageous for reasons of stability if the holding ring comprises a guide portion axially upwardly extending from the shoulder transition alongside the cylindrical body of the bottle, adjoined at the top by a support sector in cross section extending in an inward curve correspondingly to the shoulder transition.

As already mentioned, the adapter ring can be made of a plastic material of a suitable price; the adapter ring and the holding ring and the beaker-shaped closure cap are preferably made of propylene. The cap for fastening the teat is likewise preferably of polypropylene. But the body of the bottle can be of glass-clear polycarbonate.

The specification will now describe embodiments—but to which it is not limited—accompanied with drawings, wherein.

The figure also shows a closure lid above the teat.

Figure 1:
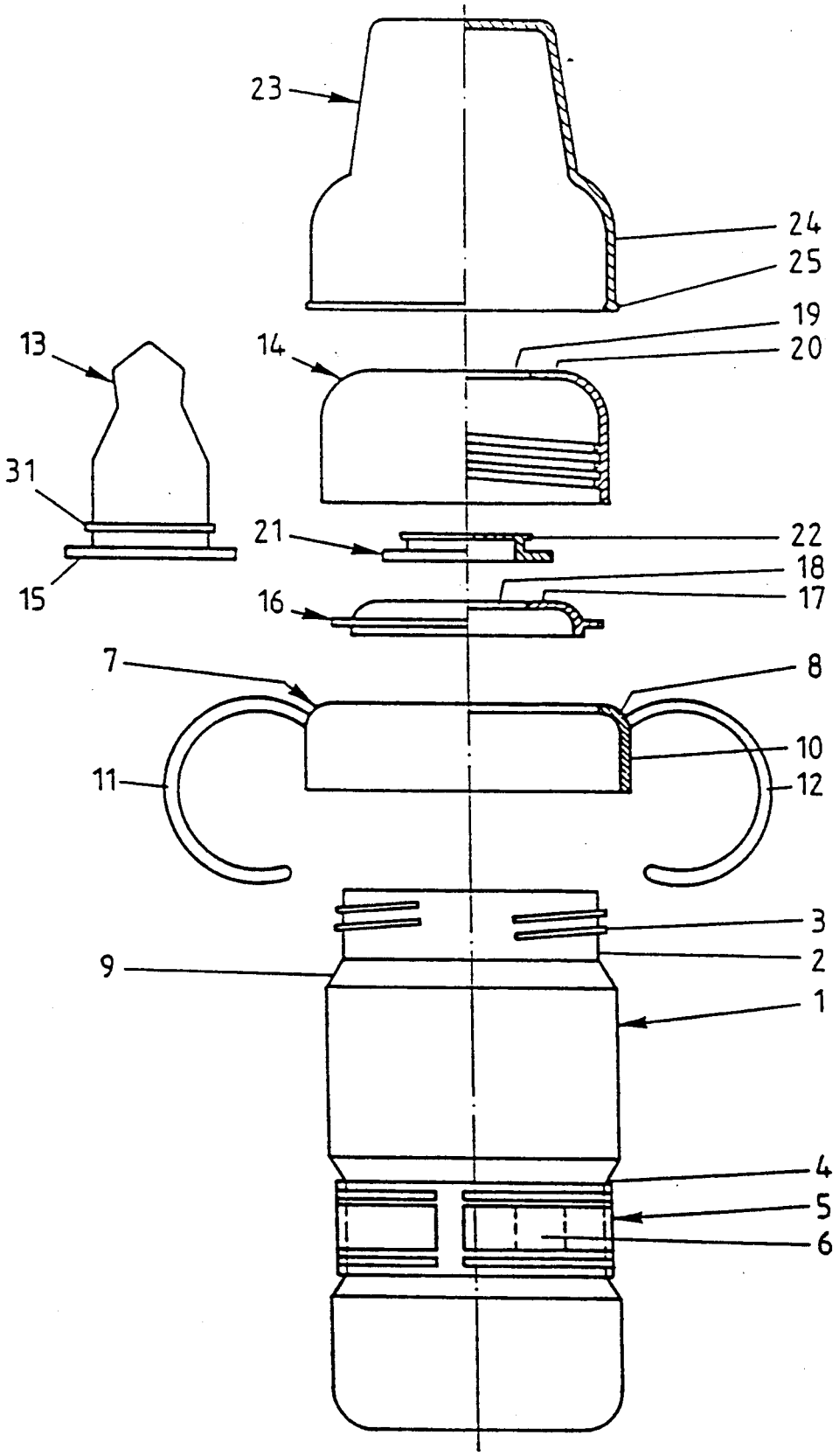
FIG. 1 is an exploded view, in elevation or axial cross-section of a feeding bottle with corresponding parts, such as teat and cap.

The feeding bottle shown in the drawing is a "system" bottle, whose parts can be combined after each momentary use—storing, transporting, dispensing baby food. The main part is the body 1 of the bottle, hereinafter called briefly bottle, having a wide neck 2 with a thread or bayonet catch, e.g. a multiple thread 3. Below about one half of its height the bottle 1 has a creased concavity 4, in which a temperature gauge ring 5 with liquid-crystal display areas 6 is detachably attached, e.g. snapped into. As seen in FIG. 1, the bottle is relatively wide and low, which makes it easy to clean it and, in addition, increases stability.

A holding ring 7—seen in FIG. 1 in elevation or in axial cross section—can be set on such bottle 1, with an upper, inwardly bent support portion 8 of the holding ring 7 in set-on condition resting on a correspondingly curved shoulder transition 9 of the bottle 1 below the neck; compare the cross sections of FIGS. 2 and 3. An axially upwardly extending guide portion 10 abuts below the support portion 8 of the holding ring, said guide portion in the set-on condition on the cylindrical bottle body 1 adjoins outwardly, the inside diameter thereof being only slightly greater than the outer diameter of the cylindrical bottle body 1.

The holding ring 7 is also provided with diametrically opposite arcuate holding grips 11, 12 shaped on the ring 7 in the transition area from the support portion 8 to the guide portion 10.

A conventional screw cap 14 is provided for fastening a teat 13. As mentioned, in order to use conventional, narrow caps, as also shown on FIG. 1, the diameter of the bottle neck must be reduced to a smaller diameter, according to the dimensions of the lower, radial flange 15 of the teat 13; this is done by a reducing part in the shape of an adapter ring, whose top side defines a counterclamping surface 17 for clamping thereagainst the teat flange 15 on screwing the cap 14 on the bottle neck 2. The adapter ring 16 has a concentric ring opening 18 of a diameter about equal to the diameter of a central, concentric opening 19 in the upper wall 20 of the screw cap 14, provided for receiving the teat 13.

Figure 2:
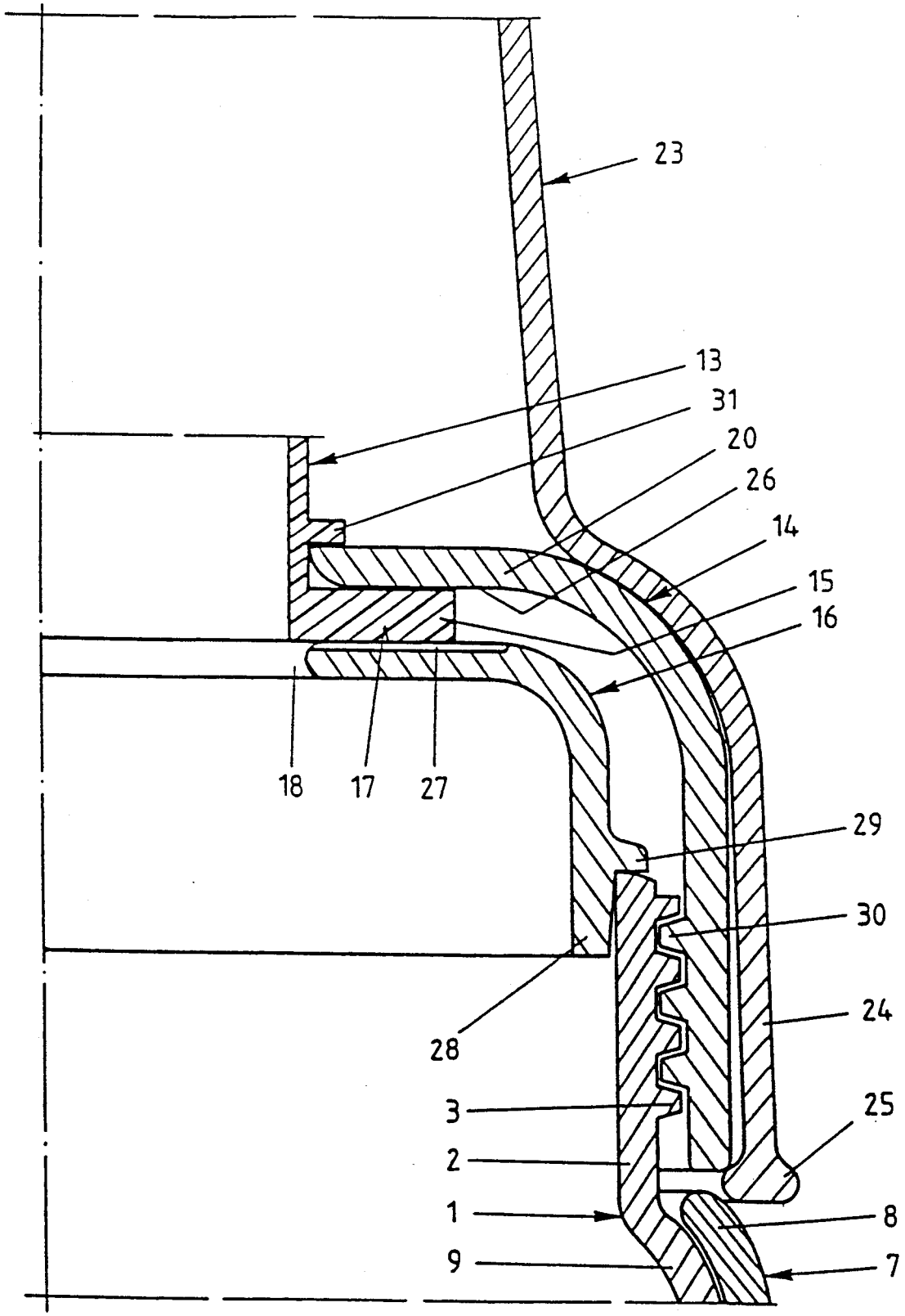
FIG. 2 is on a larger scale an axial partial cross-section of the feeding bottle in the areas of the bottle neck, with caps set on and with the clamped teat.
Figure 3:
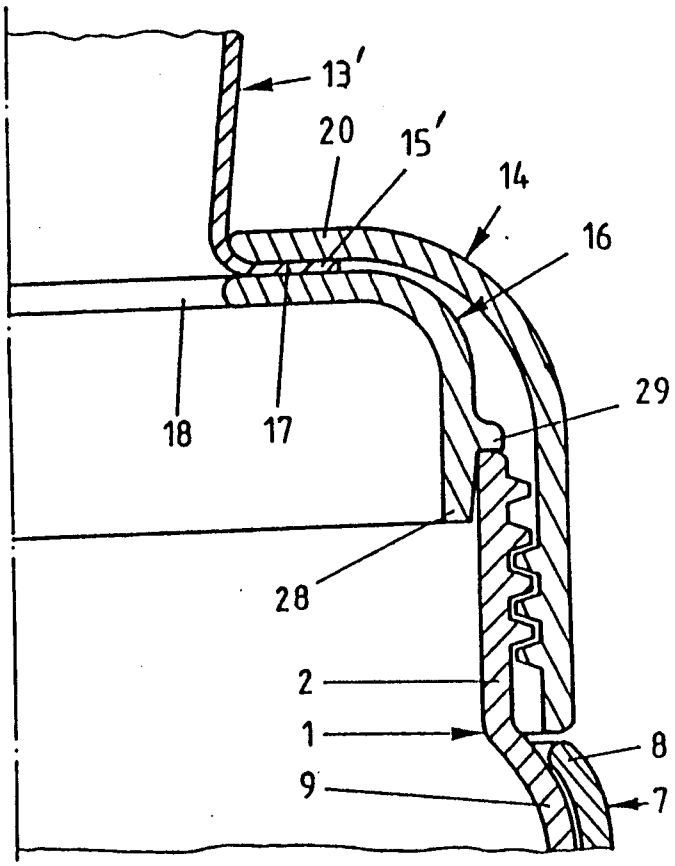
FIG. 3 is an axial partial section, like in FIG. 2, but with a modified teat.

FIG. 1 also shows a conventional closure lid 21, adapted to having its detention projection 22 snapped into the opening 19 of the screw cap 14 (see also FIG. 4), and a beaker-shaped closure cap 23 having its lower put-on section 24 complementary to the outer side of the cap 14, adapted to be snapped on the cap by means of a thickened bottom reinforcement 25; see also for example FIG. 2.

In the at least currently preferred embodiment according to FIGS. 1 to 4, the adapter ring 16 is substantially tray-shaped; its outer side extends substantially in conformity, i.e. in parallel, to the inner side of the likewise tray-shaped screw cap 14; cf. particularly FIG. 2. It is of utmost importance that for achieving a uniform surface pressure of the teat flange 15 of the teat 13, the counterclamping surface 17 of the adapter ring 16 be parallel to the clamping surface 26 on the inner or bottom side of the upper wall 20 of the screw cap 14. Both clamping surfaces 17, 26 in the shown embodiment are plane surfaces, but they can be also in the shape of a truncated cone or dome, e.g. in the shape of ball surface parts. At least one ventilation groove 27 extending outwardly from the ring opening 18 is provided in the top side, i.e. counterclamping surface 17 of the adapter ring 16, see FIG. 2. Preferably, two diametrically opposite, radially extending ventilation grooves 27 are formed in the top surface 17 of the adapter ring 16.

According to FIGS. 1 to 4, the tray-like adapter ring 16, has a downwardly offset axial flange 28, which tapers outwardly on the outer side, and with which the adapter ring 16 is inserted into the opening in the bottle neck 2, particularly under light clamping. The insertion of the adapter ring 16 with the axial flange 28 into the opening in the bottle neck is limited by a radially extending abutment, in the present embodiment in the form of a circumferential collar 29, which in the set-on position is supported on the upper edge of the bottle neck 2.

Naturally, the connection-nut screw cap 14 has in its bottom area a possibly multi-threaded means 30 or the like, which fits the thread 3 on the bottle neck 2.

As seen in FIG. 2, the teat 13 in its assembled condition has its flange 15 clamped between the adapter ring 16 and the upper wall 20 of the cap 14 with substantially broader clamping surfaces are made possible in comparison with the upper edge of the bottle neck 2. According to FIGS. 1 and 2, the teat 13 has also a smaller, upper flange 31, supported on the top side of the upper wall 20 of the cap 14; this makes it easier to pre-install the teat 13 in the opening 19 (FIG. 1) of the cap 14 before it is threaded on the bottle neck 2.

It follows from the foregoing that the use of the adapter ring or reducing part made of relatively inexpensive plastic for the broad-neck bottle 1 makes it possible to put on a small teat of usual size. It is also possible to use bottles of different cross sections with the corresponding adapter rings 16 in combination with teats of the same sizes. On the other hand, it is also possible, on the basis of the relatively broad annular, concentric clamping surfaces 17 and 26, to accept various sizes of the teat 13, inasmuch as in somewhat smaller teats, as shown in FIG. 2, the teat flange 15 can be still adequately securely clamped between the clamping surfaces 17 and 26. On the other hand, the broad clamping surfaces 17 or 26 impart to the teat flange 15 also the advantage of less surface pressure, i.e. a smaller load per surface unit, thus saving material. This, as well as the possible use of smaller teats, is important considering the preferred material for the teat 13, namely, silicone rubber. But, of course, it is also possible, to make the teat 13 of other materials, such as natural rubber.

As mentioned, due to large clamping surfaces 17 or 26, different sizes and shapes of the teats are tolerated, without affecting the reliability of clamping. FIG. 3 shows how a teat 13' with a considerably thinner radial flange 15' can be perfectly clamped.

Figure 4:
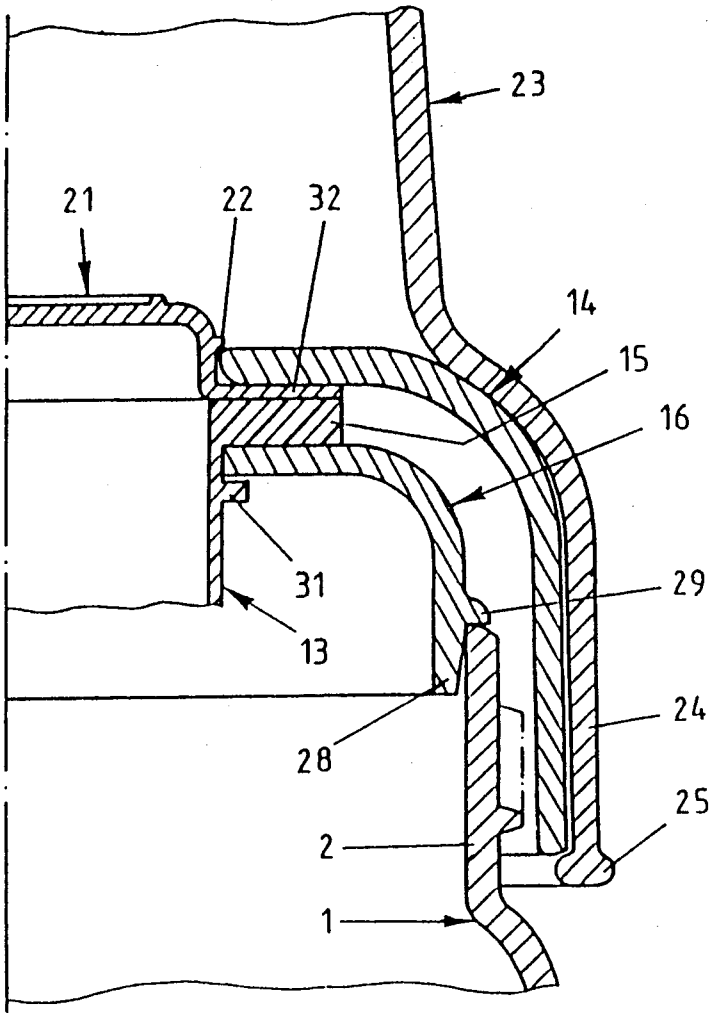
FIG. 4 is an axial partial section, like in FIGS. 2 and 3, but the teat is shown as clamped in a reverse position.

FIG. 4 shows a combination with a teat 13, like the one shown in FIGS. 1 and 2; but this teat 13 is turned by 180 degrees, i.e. projects into the inside of the bottle, as usually practiced, for example, in transporting feeding bottles. This involves setting a closure lid 21 shown in FIG. 1 over the teat 13, i.e. its teat flange 15; it is first firmly snapped on the screw cap 14, namely, in the opening !9 thereof with a snap-edge or bead on the screw cap 14, and together therewith set-on or screwed on the unit consisting of bottle 1, adapter ring 16 and teat 13. This secures a tight closing of the bottle. This can be followed by setting the closure cap 23 in the snap seat on the screw cap 14, as already explained in conjunction with FIG. 2.

The closure lid 21 resembles in cross-section a hat, where an outer edge flange 32 together with the teat flange is clamped between the adapter ring 16 and the screw cap 14.

Various embodiments of the invention have been described, but naturally modifications and changes are possible without departing from the scope of the invention. It is possible, for example, to make the opening 18 of the adapter ring 16 narrower, i.e. of a smaller diameter than the opening 19 in the cap 14, thus to counteract additionally the inward pressure of the teat 13. But this is accompanied by the disadvantage that, under circumstances, it is then not possible anymore to clamp the teat 13 in the position shown in FIG. 4, namely projecting to the inside of the bottle, since the ring opening 18 may be too small for such purpose. Naturally, it is also possible to provide a fast closure, such as a bayonet lock instead of the illustrated screw engagement between the bottle neck 2 and cap 14. Important here is only to obtain an adequate clamping force between the cap and the adapter ring on tightening the cap. To accommodate teats having flanges of different thickness, the best as a rule is a screw closure, because this makes it readily possible to provide on clamping a relatively large distance area between the cap 14 and adapter ring 16, according to the thickness of the feeding bottle.

The holding ring 7, instead of being secured against an axial upward shift by the set-on cap 14 in its active position on the shoulder transition 9 of the bottle 1, can be also secured on the bottle 1 by a stopping or snap connection, like the temperature measuring ring 5.

Glass-clear polycarbonate is preferably used as the material for the bottle 1, and polypropylene is preferably used for parts 7, 16, 21, 14 and 23. This material is sufficiently strong and resistant to heat; it can be also dyed in different colors.

I claim:

1. A feeding bottle comprising:

a bottle body including a wide bottle neck having an opening with an inner diameter;

a teat member including at one end thereof a substantially flat radial flange portion surrounding a lower entrance opening of said teat member, and having an outer diameter which is smaller than the inner diameter of said bottle neck;

a substantially rigid upwardly dome-shaped adapter ring member for bridging the space between said bottle neck and said teat member flange portion, said adapter ring member having a peripheral part detachably resting on and snugly fitting within the opening of said bottle neck, and further including on its top side a surface for supporting said teat member, the flat flange portion of the teat member merely resting with its lower surface on said supporting surface in the assembled state, said supporting surface being located around an inner central opening of said adapter ring member which, in the assembled state, is in general alignment with the lower entrance opening of said teat member; and a clamping cap member for mounting said bottle neck thereby with an inner clamping surface clamping the flat flange portion of said teat member against the supporting surface of said adapter ring member, the supporting surface thereby forming a counterclamping surface for this clamping attachment of said teat member flange portion, so that said teat member flange portion is clampingly engaged and secured between said clamping cap member and said adapter ring member, said clamping cap member having a central opening through which said teat member projects outwardly in the assembled state.

2. The feeding bottle according to claim 1, wherein said dome-shaped adapter ring member with its outer side conforms to an upper portion of the clamping cap member.

3. The feeding bottle according to claim 1, wherein the inner central opening of said adapter ring member has a diameter which is at least substantially equal to the diameter of the central opening in said clamping cap member.

4. The feeding bottle according to claim 1, wherein said peripheral part has a downwardly projecting axial flange thereby snugly fitting to the inner diameter of the opening of said bottle neck.

5. The feeding bottle according to claim 4, wherein said peripheral part has an outwardly radially extending abutment wherewith to bear, in the assembled state, on the top of the bottle neck.

6. The feeding bottle according to claim 1 or 2, wherein the counterclamping surface of said adapter ring member extends in parallel relationship with respect to the inner clamping surface of the clamping cap member.

7. The feeding bottle according to claim 2, wherein the outer side of the clamping cap member has a shape conforming to the inner side of a positioning section of a cup-shaped snapping-on cover cap.

8. The feeding bottle according to claim 1, wherein said adapter ring member is made of polypropylene.

9. The feeding bottle according to claim 1, wherein said clamping cap member is made of polypropylene.

10. The feeding bottle according to claim 7, wherein said cup-shaped cover cap is made of polypropylene.

* * * * *